US005382393A

United States Patent [19]

Steinke

[11] Patent Number: 5,382,393

[45] Date of Patent: Jan. 17, 1995

[54] METHOD AND APPARATUS FOR FORMING CHAMFERED OUTSIDE CORNERS ON CONCRETE PRODUCTS

[76] Inventor: Robert J. Steinke, 98-889 Ka'ahele St., Aiea, Hi. 96701

[21] Appl. No.: 72,515

[22] Filed: Jun. 4, 1993

[51] Int. Cl.[6] ..... E04B 1/16; E04G 9/00

[52] U.S. Cl. ..... 264/31; 249/35; 249/188; 264/219

[58] Field of Search ..... 249/26, 27, 47, 192, 249/193, 194, 188, 35, 187.1; 52/254, 255, 287.1, 288.1, 743; 264/221, 31, 219; 425/DIG. 107, 470

[56] References Cited

U.S. PATENT DOCUMENTS

| | | | |
|---|---|---|---|
| 1,331,096 | 2/1920 | Eaches | 249/188 |
| 2,985,938 | 5/1961 | Rappas | 249/188 |
| 2,991,532 | 7/1961 | Stiles | 249/188 |
| 3,782,680 | 1/1974 | Hopkins | 249/188 |
| 4,183,497 | 1/1980 | Tamez | 249/194 |
| 5,086,598 | 2/1992 | Weldy | 52/288.1 |

FOREIGN PATENT DOCUMENTS

| | | | |
|---|---|---|---|
| 2348117 | 4/1975 | Germany | 249/188 |

*Primary Examiner*—Jay H. Woo
*Assistant Examiner*—Robert B. Davis
*Attorney, Agent, or Firm*—Arnold, White & Durkee

[57] ABSTRACT

A method and apparatus for forming chamfered outside corners on a concrete product which uses a body made of molded material and having three intersecting perpendicular arms. Each of the arms has a triangular cross-sectional shape so that each arm forms a chamfered surface at two intersecting planar portions of the concrete product. The outside corner itself is formed by the intersection of the arms and is appropriately shaped to define the desired configuration. Planar forming members are assembled to create the desired cast concrete shape. Triangular chamfer forming members are secured to the form where two formed surfaces are to intersect. Where three surfaces would intersect to form an outside corner in the finished product, the molded body is secured to the planar forming members in an appropriate position to form the desired corner shape.

11 Claims, 1 Drawing Sheet

METHOD AND APPARATUS FOR FORMING CHAMFERED OUTSIDE CORNERS ON CONCRETE PRODUCTS

FIELD OF THE INVENTION

The present invention relates generally to a method and apparatus for forming concrete products and particularly to such forms which include means for chamfering the corners of such products.

BACKGROUND OF THE INVENTION

A variety of concrete products are often formed in place at building sites or other construction areas. It is usually the case that corners formed by the intersection of two planes are generally preferred to be chamfered since otherwise concrete may crack or break at the corner.

In conventional construction, the forms may be made of plywood sheets that which are nailed together to form a right angle corner. In order to form the chamfer within the corner, a triangular piece of wood may be nailed inside the intersecting plywood sheets.

However, a problem arises with respect to concrete products which have three intersecting perpendicular surfaces. In this situation, the wooden members forming the chamfers intersect at a very complex point. The three intersecting wooden members must be elaborately cut in order to form a chamfered corner where the three surfaces intersect. Obviously, this may be difficult to accomplish even within a factory with elaborate equipment. However, it is even more difficult when the corner intersection must be cut at a building site. As a result, forming such chamfered corners is an extremely time consuming and expensive process.

It would be highly desirable to provide a method and apparatus for forming such chamfered corners with ease at any location.

SUMMARY OF THE INVENTION

These and other aspects of the present invention may be achieved by a concrete form for forming chamfered corners. The form includes a body made of molded material having three intersecting perpendicular arms. Each of the arms has a triangular cross-sectional shape. Each arm also has a pair of facial surfaces that meet at a right angle. The facial surfaces of each arm are coplanar with the facial surfaces of an adjacent arm. Each arm has a third surface adapted to form a chamfered face on a cast concrete product.

In accordance with another aspect of the present invention, a method for forming a chamfered corner on a concrete product includes the step of defining the surfaces of a concrete product using planar forming members. A preformed member is secured to the planar forming members to form a chamfered corner where three formed surfaces are to meet in perpendicular relation to one another. The preformed member includes at least two arms. Each of the arms is aligned with a triangular chamfer forming member. Triangular chamfer forming members may be secured to the interior of a planar forming member to form chamfered edges.

In accordance with yet another aspect of the present invention, a method for forming a pair of chamfered corners on a concrete product involves defining the surfaces of the concrete product using planar forming members. Spaced preformed members are secured to the planar forming member to form a pair of spaced chamfered corners where formed surfaces intersect. A chamfer forming strip is sized to extend from the end of one of the arms of one preformed member to the end of an arm of the other spaced preformed member. The chamfer forming strip is then secured to one of the planar forming members, in alignment with a pair of arms of the spaced preformed members.

In accordance with still another aspect of the present invention, a concrete form includes a frame for receiving concrete. The frame includes planar facing members adapted to define the shape of the finished concrete product. Triangular chamfer forming members are secured to the planar forming members to define a chamfered edge where two formed surfaces intersect. A pre-formed member has three intersecting arms. Each of these arms has a triangular cross-sectional shape substantially similar to the cross-sectional shape of the chamfer forming member. The pre-formed member is aligned such that each of its arms is aligned with and abuts with one of the triangular chamfer forming members, such that a chamfered edge may be formed where three concrete surfaces intersect.

DETAILED DESCRIPTION OF THE PREFERRED EMBODIMENT

Figure 1:
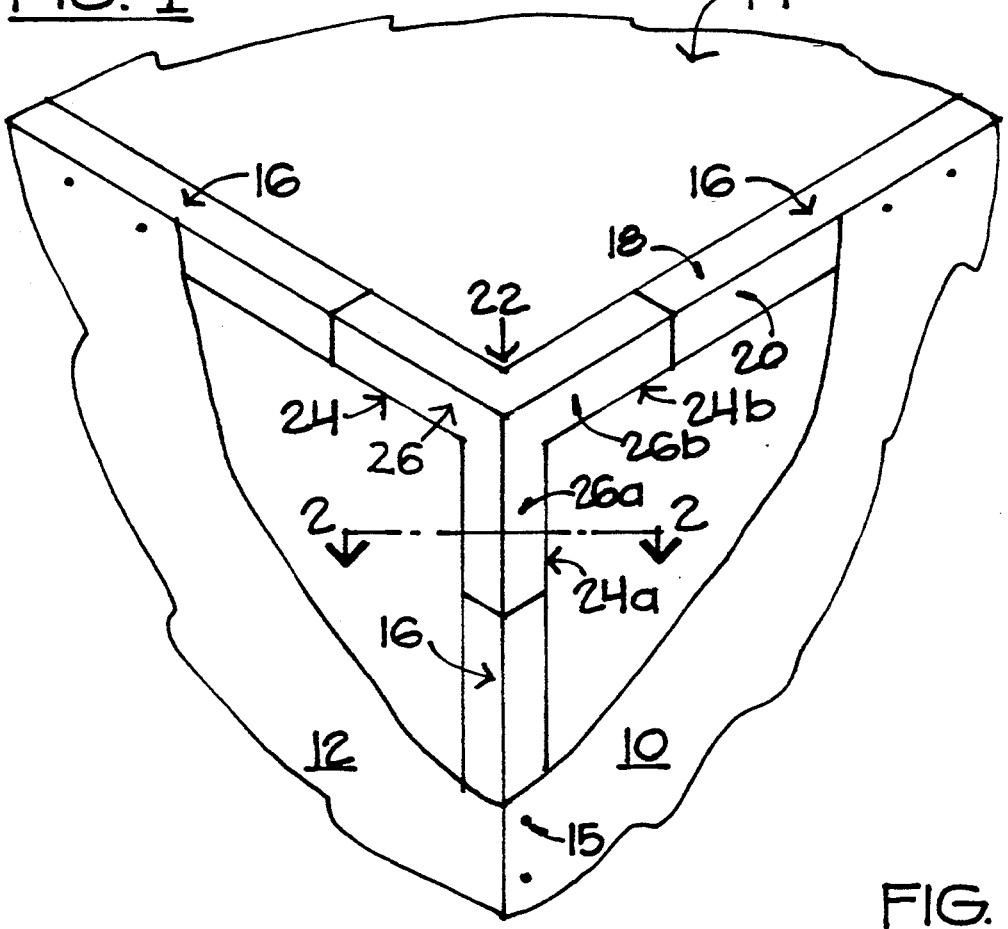
FIG. 1 is a partial, cutaway view of a corner of a form used to make a chamfered corner where three surfaces intersect.

Referring to the drawing wherein like reference characters are used for like parts throughout the several views, a form for a concrete product, shown in FIG. 1, includes two intersecting planar forming members 10 and 12 which may be made up of planar building materials such as conventional plywood. The top surface 14 of the product is not formed since the surface may be smoothed and readied by conventional concrete finishing techniques. The planar forming members 10 and 12 may be secured together by nails 15 or other suitable fasteners.

Inside the form, chamfered corners are defined where surfaces intersect by securing triangularly shaped wooden chamfer forming strips 16 to the interior comers of the form. For example, the strips 16 may be secured by nails 15 to the surfaces 10 and 12. The wooden chamfer forming strips 16 have two exterior surfaces 18 and 20 which intersect one another at an exterior right angle and a third surface extending between the two perpendicular surfaces to define the chamfered edge of the finished concrete product.

In order to form a concrete surface where three different formed surfaces intersect, it is extremely difficult to use chamfer forming strips 16. In accordance with the present invention, a molded member 22 is utilized for this function. The member 22 may be formed of molded material which is sufficiently soft to frictionally engage and be secured by a nail or any other fastener. For example, the member 22 may be formed of soft molded plastic, rubber, rubber-like materials, or metals such as aluminum.

Figure 2:
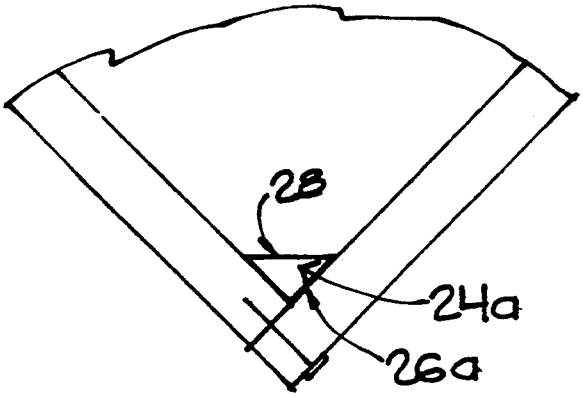
FIG. 2 is an enlarged, cross-sectional view taken generally along the line 2—2 in FIG. 1.

The member 22 has three intersecting perpendicular arms 24. Each of the arms has a triangular cross-sectional shape, as shown in FIG. 2, and the cross-sectional shape of each arm is substantially similar to the cross-sectional shape of each strip 16. The facial surface 26 of each arm 24 is coplanar with the facial surface of an adjacent arm. Thus, the facial surface 26*a* of arm 24*a* is coplanar with the facial surface 26*b* of arm 24*b*. Each arm 24 also has a third surface 28 adapted to form a chamfered face on the cast concrete product.

A chamfered corner on the concrete product is formed as follows. First, the form is defined by securing together planar forming members 10 and 12. The form is defined to contain the concrete but may have an open top. Then, a member 22 is secured to the planar forming members 10 and 12 to form chamfered outside corners where three formed surfaces meet in perpendicular relation to one another. Next, chamfer forming strips 16 having triangular cross-sections are secured to the interior of the planar forming members 10 and 12 so that a chamfered corner may be formed where two surfaces intersect. The strips 16 are cut and then secured so that each arm 24 aligns with and abuts with a strip 16.

Thus, a pair of spaced preformed members may be secured in place. The distance between the arms of opposed spaced members 22 can be measured, and the appropriate length of strip 16 may be cut and secured in place, in alignment with the opposed members 22. After the concrete sets up, the form is removed.

Figure 3:
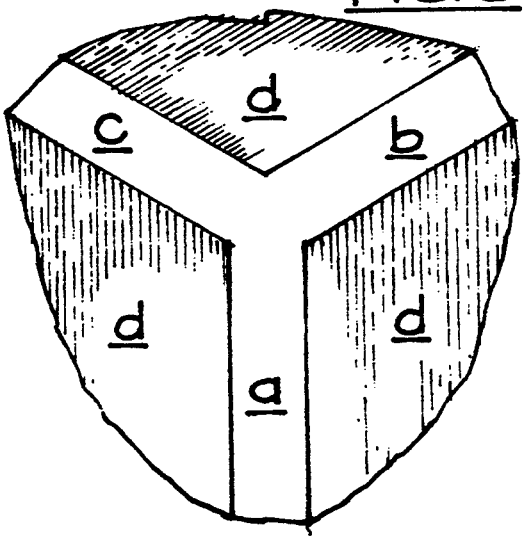
FIG. 3 shows the corner in the finished concrete product which results from the use of the form shown in FIG. 1.

The resulting outside corner is shown in FIG. 3. The three concrete surfaces d are generally perpendicular to one another and intersect at chamfered surfaces a, b and c. The smooth chamfers a, b and c prevent damage to the concrete.

Thus, it is apparent that there has been provided, in accordance with the invention, a method and apparatus that fully satisfies the aims and advantages set forth above. While the invention has been described in connection with specific embodiments, it is evident that many alternative modifications and variations will be apparent to those skilled in the art in light of the foregoing description. Accordingly, it is intended to embrace all such alternatives, modifications and variations as following the spirit and scope of the appended claims.

I claim:

1. A concrete form for forming chamfered corners comprising a body made of molded material and having three intersecting perpendicular arms, each of said arms having a triangular cross-sectional shape, each arm further having a pair of facial surfaces that meet at a right angle, the facial surfaces of each arm being coplanar with the facial surface of an adjacent arm, each arm having a third surface adapted to form a chamfered edge on a cast concrete product.

2. The form of claim 1, wherein said molded material is plastic.

3. The form of claim 2, wherein said molded material is nailable plastic.

4. A method for forming a chamfered corner in a concrete product comprising the steps of:

defining the surfaces of the concrete product using planar forming members;

securing a pre-formed member to the planar forming members to form a chamfered corner where three formed surfaces are to meet in permanent perpendicular relation to one another, said pre-formed member having three arms;

securing triangular chamfer forming members to the interior of said planar forming members to form chamfered edges where two formed surfaces are to meet in perpendicular relation to one another, an end of each arm of said pre-formed member being aligned with an end of one of said chamfer forming members; and forming the concrete by adding the concrete to the form and allowing it to harden.

5. The method of claim 4, wherein said pre-formed member is nailed to a planar forming member.

6. The method of claim 4, wherein said members are arranged to form an outside corner.

7. A method for forming a pair of chamfered corners on a concrete product comprising the steps of:

defining the surfaces of the concrete product using planar forming members;

securing spaced pre-formed members to the planar forming members to form a pair of spaced chamfered corners where formed surfaces intersect;

sizing a chamfer forming strip to extend from the end of one of said arms of said pre-formed member to the end of an arm of a spaced pre-formed member;

securing said chamfer forming strip to one of said planar forming members in alignment with an opposed pair of arms of the spaced pre-formed members; and forming the concrete product by adding concrete to the form and allowing it to harden.

8. A concrete form, comprising:

a frame for receiving concrete, said frame including planar forming members adapted to define the shape of the finished concrete product;

triangular chamfer forming members secured to said planar forming members to define a chamfered edge where two formed surfaces intersect: and a pre-formed member having three intersecting arms, each of said arms having a triangular cross-sectional shape substantially similar to the cross-sectional shape of said chamfer forming members, said pre-formed member being aligned such that each of its arms is aligned with and abuts with one of said triangular chamfer forming members, such that a chamfered corner may be formed where three concrete surfaces intersect.

9. The form of claim 8, wherein said pre-formed member is made of molded material.

10. The form of claim 9, wherein said pre-formed member is made of nailable plastic.

11. The form of claim 8, wherein each of said arms includes a pair of facial surfaces that meet at a right angle, each of said facial surfaces of each arm being coplanar with the facial surfaces of an adjacent arm, each arm further including a third surface adapted to form a chamfered edge on a cast concrete product.

* * * * *